United States Patent [19]

Gustafsson

[11] 4,060,037

[45] Nov. 29, 1977

[54] PALLET

[76] Inventor: Hans Hjalmar Gustafsson, 22 Tradgardsgatan, S-172 38 Sundbyberg, Sweden

[21] Appl. No.: 751,034

[22] Filed: Dec. 16, 1976

Related U.S. Application Data

[63] Continuation-in-part of Ser. No. 539,942, Jan. 10, 1975, abandoned.

[30] Foreign Application Priority Data

Jan. 21, 1974 Sweden ..... 7400759

[51] Int. Cl.[2] ..... B65D 19/00

[52] U.S. Cl. ..... 108/51.1; 108/55.1

[58] Field of Search ..... 108/51.1–57.1; 206/386, 595–600; 214/10.5 R; 217/43 A; 248/346

[56] References Cited

U.S. PATENT DOCUMENTS

| | | | |
|---|---|---|---|
| 1,784,909 | 12/1930 | Romine | 108/51.1 X |
| 2,544,743 | 3/1951 | Vrabcak | 108/52.1 |
| 2,668,681 | 2/1954 | Kappen | 108/52.1 |
| 2,745,523 | 5/1956 | Biggs | 52/545 X |
| 3,131,655 | 5/1964 | Sellers et al. | 108/55.1 X |
| 3,148,637 | 9/1964 | Lund | 108/53.1 |
| 3,251,322 | 5/1966 | Downs et al. | 108/51.1 |
| 3,269,336 | 8/1966 | Naylor et al. | 108/55.1 X |
| 3,393,646 | 7/1968 | Giacobe | 108/55.1 |
| 3,722,430 | 3/1973 | Woodley et al. | 108/51.1 |

*Primary Examiner*—Roy D. Frazier
*Assistant Examiner*—William E. Lyddane
*Attorney, Agent, or Firm*—Kinzer, Plyer, Dorn & McEachran

[57] ABSTRACT

A pallet having a rectangular shaped load carrying deck of generally uniform thickness. The deck is formed of several sheets of flexible wooden material with spring characteristics. The sheets of flexible wooden material are superimposed on one another and formed to be arcuate about a single axis. The sheets are glued together so as to constitute an arcuate structure substantially free from inherent tension forces in its unloaded condition and having sufficient elasticity to assume a substantially planar form under load. Supporting means are attached to the under convex side of the deck. The supporting means are arranged in a plurality of parallel rows extending in the direction of the single axis. One of the rows is located in the plane intersecting the axis and a line on the deck substantially corresponding to the central deck line. A second row of supports extend along the first outer edge portion of the deck and a third row of supports extend along a second outer edge portion of the deck.

5 Claims, 8 Drawing Figures

Fig. 1.
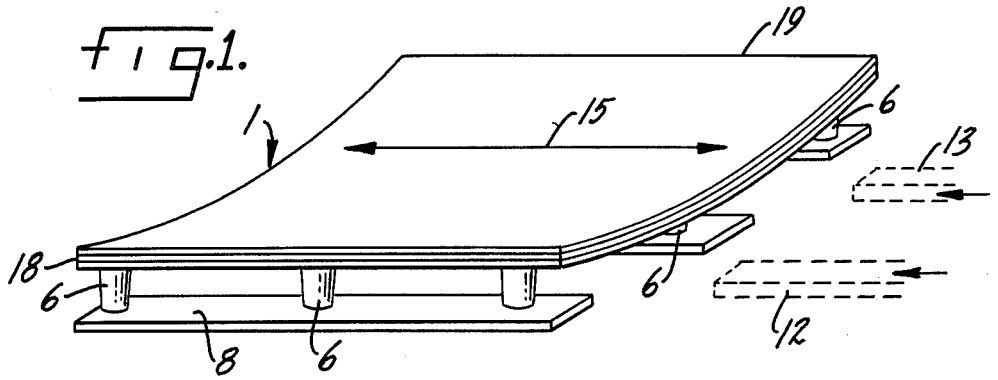
Fig. 2.
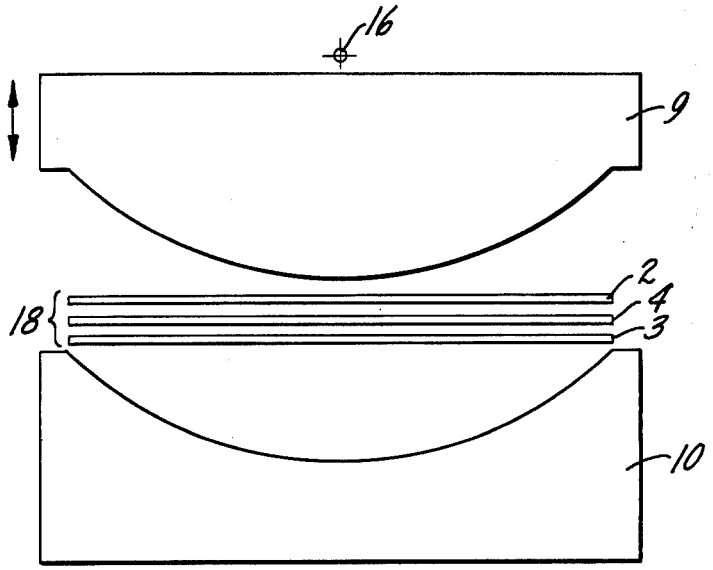
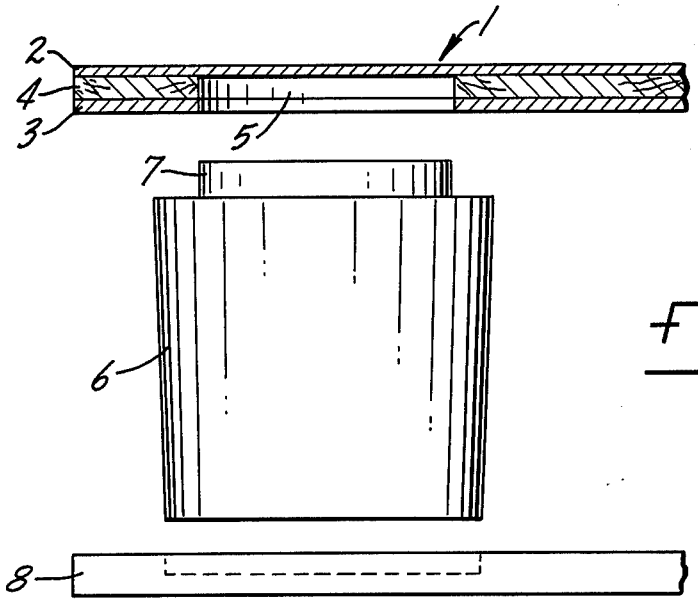
Fig. 3.

fig.4.
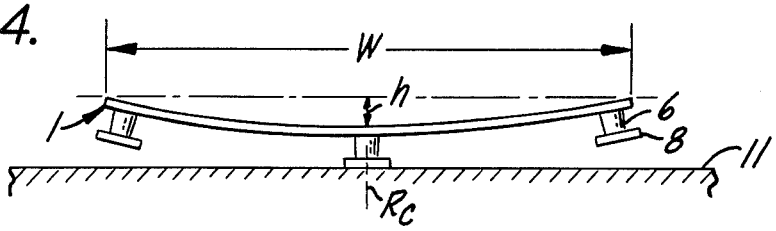
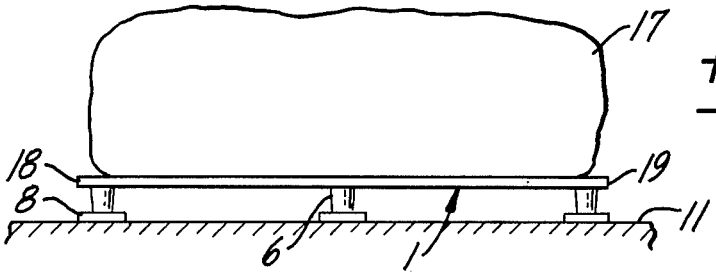
fig.5.
fig.6.
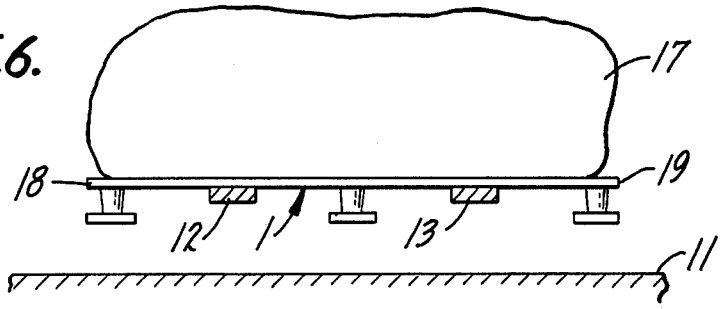
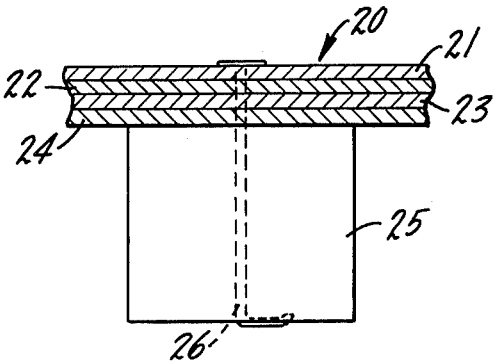
fig.7.
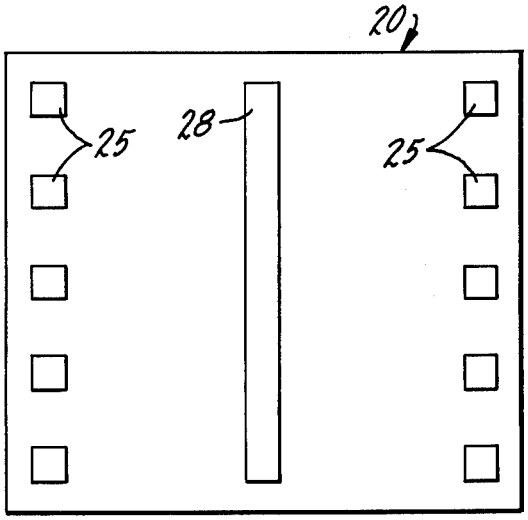
fig.8.

PALLET

This is a continuation-in-part of my application Ser. No. 539,942 filed Jan. 10, 1975 now abandoned.

The invention relates to a pallet having a load carrying deck made from a fibrous material and being provided on its underside with supporting means.

Attempts with pallets of this simple construction have not so far given acceptable results and, therefore, loading pallets made from homogenous and expensive timber still dominate the market.

U.S. Pat. No. 2,544,743 to Vrabcak discloses a pallet made from a molded or pressed material, such as pressed paper. The deck consists of a single sheet of said material and is corrugated to create downwardly extending channels parallel with one another.

The portions between the channels constitute the load bearing platform upon which articles may be placed. The several channels have bottoms positioned in a common plane so that the bottoms will rest on the ground or floor. The major disadvantage with a pallet of this type is the lack of stiffness in the direction of the parallel corrugations and therefore, the only practical possibility to handle the pallet with a fork truck is to provide the sides of the corrugations with holes for the fork. The tines of the fork will thus be introduced perpendicular to the corrugates. The holes for the tines weaken, however, the side portions of the corrugations or channels which serve as stiffening members and complicate the manufacture of the pallet.

U.S. Pat. No. 3,393,646 discloses another pallet made from a plastic material and provided with a flat deck arranged to be concave under load. This known pallet is provided with two channels for the tines of a lifting fork near the outer side portions of the deck. One of the disadvantages with this known pallet is that as the load on the deck increases, the deck becomes more distorted thus causing more pronounced bending where the deck connects with the outer sides of the channels. The most important disadvantage is, however, that the deck is all too weak to allow lifting of a heavy load by the aid of a fork because the deck will break along a central axis due to its weakness.

The main purpose of the invention is, therefore, to provide a cheap and light pallet which can be heavily loaded and still handled by a fork lift truck and for which the problems touched on above have been eliminated.

Other purposes and objects of this invention will become apparent from a consideration of the following description when taken in connection with the accompanying drawing in which:

FIG. 1 shows a perspective view of a pallet according to the invention,

FIG. 2 discloses a method of manufacturing a deck according to the invention,

FIG. 3 shows a supporting means and an exemplary fastening method,

FIG. 4 shows a simplified end view of a pallet according to the invention in unloaded condition, FIG. 5 shows the pallet of FIG. 4 in loaded condition, FIG. 6 shows the pallet of FIG. 5 as being lifted by a fork lift truck, FIG. 7 discloses a portion of a deck according to the invention and a support means, and FIG. 8 shows the underside of a modified pallet.

FIG. 1 shows a pallet according to the invention with a load surface or deck 1 which, as seen from above, is concave and curved about a single straight axis lying above the deck and above the centerline 15 of the deck 1. The axis of curvature is illustrated in FIG. 2 and is denoted by the numeral 16. The deck 1 consists of a panel of uniform thickness, composed of a plurality of sheets of a wood material, e.g. oil-hardened hard fiberboard, hardboard or the like. Sheets of such wood material can be considered as thin flat springs. FIG. 3 illustrates in greater detail a laminated deck according to a preferred embodiment of the invention, the deck 1 consisting in this case of an upper layer of hard fiberboard, hardboard or the like, for the sake of example with a thickness of 3.2 mm, an intermediate layer 4, consisting of the same or other wood material, and a lower layer 3 consisting of the same material. These three layers 2, 3 and 4 are glued to each other over the whole of their contacting surfaces. The deck can also consist of sheets of solid wood placed on top of each other, of plywood or similar material having resilient characteristics, and does not need to be uniformly thick, as is shown on the drawing, but can be given a profile suited to providing desired bending properties and resilient function.

In FIG. 2 there is shown, extremely simplified, the production of a deck of the type shown in FIG. 1, bent about an axis 16. In FIG. 2 the numeral 10 denotes a mold with a curved surface corresponding to the desired surface and curvature of a completed deck, 9 denotes a forming tool arranged to be moved to and away from the mold 10. In the position shown, the tool is spaced from the mold 10 and the flat sheets 2, 3 and 4 corresponding to the sheets according to FIG. 3, have been provided with a setting glue on their opposing surfaces and have been inserted between the mold 10 and the forming tool 9. When the forming tool 9 is driven downwards by operating means not shown here, the sheets 2, 3 and 4 will be pressed together in the space between the tool 9 and the mold 10 to obtain the shapes shown in FIG. 1. It is assumed that there are means known per se for setting the glue between the sheets 2, 3 and 4. It should be noted that the bending radius shown, i.e., the radius between the axis 16 of curvature and the surface of the mold 10 is considerably less than the radius of curvature which would be used in practice. It may thus be mentioned that a deck according to the invention which is square and has a side W (see FIG. 4) has a rise $h$ of 2 cm. These dimensions have only been given as an example and can naturally be varied, although they give an impression of the actual values.

As is apparent from FIG. 1, the edge 18 of the deck 1 is substantially parallel to the axis 16 of curvature, there being supporting legs 6 mounted on the deck 1 adjacent the edge 18, and these legs 6 in turn are attached to a wooden batten 8. Corresponding supports 6 and batten 8 are mounted adjacent the opposite edge 19 and similarly along the center line 15 of the deck. Between the three battens 8 shown, there are formed a pair of channels which can accommodate the tines 12, 13 of a fork truck for lifting the pallet, as is explained more closely below.

The deck 1, which thus consists of a plurality of sheets 2, 3, 4 rigidly united to each other, will thus be curved about a single axis 16 to form thereby a strong flat spring, in an unloaded state having the curvature brought about by pressing according to FIG. 2, the deck also being unstressed in this unloaded condition. Further sheets can naturally be laminated together so that a stronger resistance to deflection is obtained. The thickness of the sheets 2, 3 and 4 has been selected so that on being loaded with a maximum calculated load, the deck 1 deflects to a completely planar state, or to a state with a considerably greater radius of curvature than in the unloaded condition.

FIG. 3 illustrates a structure, selected as an example, for attaching a supporting leg 6 to the deck according to FIG. 1, and the attachment of the batten 8 onto the supporting leg. As is apparent from FIG. 3, the lower sheet 3 and the central sheet 4 have been provided with a recess 5, in which a supporting leg 6 is placed and attached with the aid of glue, nails, screws or other suitable means. The supporting leg 6 has at its upper end a reduced cylindrical portion 7 fitting the recess 5. As has been mentioned, such supports 6, arranged in three rows according to FIG. 1, can be mounted on a wooden batten 8 provided with recesses for the respective leg, said wooden batten being attached to the underside of the legs 6 by suitable means, e.g., nails.

In order to obtain the desired bending properties and strength of the panel 1 in its function as a spring, the underside of the deck can be provided with a layer of wooden strips or similar material, not shown here, arranged in a plurality of layers lying on top of each other to give a desired cross-sectional configuration.

By forming the deck as a concave spring, seen from above, with very good resilient properties, the vital advantage is obtained that the goods are securely retained on the upper load carrying surface of the deck, and that on deflection, the deck will balance the loading forces, allowing the whole pallet with its load to be lifted with the help of a fork truck without any risk at all of the edges 18, 19 being bent downwards so that the load slides off.

The function of a pallet according to the invention is illustrated more closely in FIGS. 4, 5 and 6. FIG. 4 shows a pallet according to FIG. 1, seen from one end and in the direction of the axis 16 of curvature. It is pointed out once again that the curvature of the deck 1 is somewhat exaggerated, and that for example a width W of 80 cm there is a rise h, e.g., of 2 cm. The pallet in FIG. 4 is shown in an unloaded state, and it may be seen that the central row of supports placed in the central portion $R_c$ of the deck rest against the substructure 11, e.g., a floor. The supporting means placed along the edge portions 18, 19 of the deck 1 are at a distance from the substructure 11, in FIG. 4. When a load 17 has, according to FIG. 5, been applied to the load deck 1, this resilient deck will flatten out so that the supporting means along the longitudinal edges 18 and 19 touch the floor 11. Since the deck 1 forms a spring which is dimensioned for the load 17, the upwardly directed spring forces from the deck 1 will substantially counteract the downwardly directed forces from the load 17 and the contact pressure between the supporting means at the edges 18 and 19 and the floor 11 will be considerably less than the force between the central supporting means and the floor 11. For a certain load, the central supporting means, i.e., the supporting means along the central plane $R_c$, will take up the whole load. When, as is shown in FIG. 6, tines 12, 13 are inserted under the deck and the pallet with its load 17 is lifted therewith, the edge portions 18, 19 of the deck 1 will, therefore, completely counteract the downwardly directed forces of the load, and there is no risk that these edge portions 18 and 19 will be deflected downwards so that the load slides off.

In FIG. 7 there is illustrated a support 25, consisting of a wooden block, attached by means of a nail 26 to the underside of the deck 20. The deck 20 is concave as seen from above as with the deck 1 shown in FIG. 1. In this case, the deck 20 consists of four initially flat sheets 21,22,23,24 of hardboard, or similar resilient wooden material. These sheets have been glued to each other during forming in a way described in conjunction with FIG. 2. FIG. 8 illustrates the underside of a pallet according to the invention, in which the central supporting means consists of a beam 28. Two rows of supporting means 25 have been arranged adjacent the edges. The rows of supporting means 25 and beam 28 are parallel to the axis of curvature of the deck 20, i.e., the axis denoted by the numeral 16 in FIG. 2. The supports 25 are here shown unattached to an underlying batten corresponding to the batten 8 in FIG. 1, and their cross-sectional area is quadratic, but of course, any shape of supporting leg at all can be used. It is obvious that both rows of supporting legs 25 can also be replaced by longitudinal beams 28, the latter made to advantage from wood.

If the supporting means along the edges and the supporting means along the central portion of the deck have the same height, the deck will be deflected into a completely planar state, as is illustrated in FIG. 5. It is, however, also possible to make the outer supporting means, i.e., the supporting means along the edge portions 18 and 19 of the deck, somewhat higher than the central supporting means, whereby the deck cannot be brought into a completely flat state on being loaded, but retains a somewhat concave condition. This is especially advantageous if the load 17 (FIG. 5) should exceed the calculated load, since in such a case, a further deflection against the action of the supporting forces in the deck can be allowed when lifting the pallet, without risk of the side edges 18 and 19 hanging down.

A curved deck according to the invention, consisting of a plurality of mutually rigidly attached sheets, said sheets having a resilient action, has in practice shown itself completely to meet the demands made on a light and strong structure which can be lifted by a fork truck, without the risk that during lifting the deck will be curved so that it appears convex from above.

I claim:

1. A pallet including:

a rectangular load carrying deck of generally uniform thickness formed of several sheets of flexible wooden material having spring characteristics, the sheets being superimposed upon one another and formed to be upwardly concave about a single axis and glued together so as to constitute an upwardly concave structure substantially free from inherent tension forces in its unloaded condition and having sufficient elasticity to assume a substantially planar form under load, and supporting means attached to the under convex side of said deck, said supporting means being arranged in a plurality of parallel rows extending in the direction of the axis of curvature of the deck, one of said rows being located in a plane intersecting the axis and a line on the deck substantially corresponding to a transverse center deck line, a second row extending along a first outer edge portion of the deck and a third row extending along a second outer edge portion of the deck, the supporting means being of the same height so that all of the supporting means cannot touch a supporting surface for the pallet in the unloaded condition thereof but will allow the deck to assume a planar shape with all of the supporting means in contact with the supporting surface under load.

2. The pallet of claim 1 in which each of said supporting means includes a plurality of independently attached legs arranged in a row.

3. A pallet as claimed in claim 1, in which said supporting means includes at least one beam extending along a central line of the deck parallel to said axis.

4. A pallet as claimed in claim 2, in which the legs in each row are secured to underlying stringers.

5. A pallet as claimed in claim 1, in which each of said sheets consists of hardboard.

* * * * *